US009427097B2

(12) United States Patent
Choueifati et al.

(10) Patent No.: US 9,427,097 B2
(45) Date of Patent: Aug. 30, 2016

(54) REFRIGERATION CONTROL USING A DOOR HANDLE PROXIMITY SENSOR

(71) Applicant: Hill Phoenix, Inc., Conyers, GA (US)

(72) Inventors: Jules G. Choueifati, Richmond, VA (US); Lyman W. Wycoff, Chester, VA (US)

(73) Assignee: Hill Phoenix, Inc., Conyers, GA (US)

( * ) Notice: Subject to any disclaimer, the term of this patent is extended or adjusted under 35 U.S.C. 154(b) by 321 days.

(21) Appl. No.: 14/285,402

(22) Filed: May 22, 2014

(65) Prior Publication Data

US 2015/0335175 A1 Nov. 26, 2015

(51) Int. Cl.
*A47F 3/04* (2006.01)

(52) U.S. Cl.
CPC ..... *A47F 3/0478* (2013.01); *A47F 3/0408* (2013.01); *F25D 2700/04* (2013.01)

(58) Field of Classification Search
CPC . A47F 3/0408; A47F 3/0478; F25D 2700/04
USPC ..... 62/186, 255, 256; 236/51; 340/686.6
See application file for complete search history.

(56) References Cited

U.S. PATENT DOCUMENTS 6,745,581 B2 * 6/2004 King ..... F25D 29/00 236/47
8,212,430 B2 * 7/2012 McCoy ..... H02J 7/025 307/154
8,745,203 B2 * 6/2014 McCoy ..... G06F 9/541 370/254
2008/0264092 A1 * 10/2008 Chase ..... B67D 1/0858 62/389
2011/0175742 A1 * 7/2011 Shin ..... F25D 17/065 340/635

OTHER PUBLICATIONS

Capacitive Sensor Operation and Optimization, LION Precision, TechNote, Nov. 2012, 13 pages.

* cited by examiner

*Primary Examiner* — Timothy L Maust
(74) *Attorney, Agent, or Firm* — Foley & Lardner LLP

(57) ABSTRACT

A temperature-controlled display device includes a temperature-controlled space and a refrigeration circuit configured to provide cooling for the temperature-controlled space. The refrigeration circuit is configured to operate in multiple cooling modes including a normal refrigeration mode and an anti-ingression mode. A proximity sensor is configured to detect an object such as a human hand or forearm within a detection zone adjacent to a door handle of the temperature-controlled display device. A controller estimates a distance between the handle and the detected object using an input from the proximity sensor. The controller causes the refrigeration circuit to transition between the multiple cooling modes based on the estimated distance.

34 Claims, 11 Drawing Sheets

$$I(t) = C\frac{dV(t)}{dt} \quad (82)$$

$$C = \frac{\varepsilon_0 KA}{d} \quad (84)$$

REFRIGERATION CONTROL USING A DOOR HANDLE PROXIMITY SENSOR

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

The present invention relates generally to the field of temperature-controlled display devices (e.g. refrigerated display devices or cases, etc.) having a temperature-controlled space for storing and displaying products such as refrigerated foods or other perishable objects. More specifically, the present invention relates to a control system for operating a temperature-controlled display device. More specifically still, the present invention relates to a control system for a temperature-controlled display device that uses sensory input from a proximity sensor integrated with the display case door handle to control conditions within the temperature-controlled space.

Temperature-controlled display devices (e.g., refrigerators, freezers, refrigerated merchandisers, refrigerated display cases, etc.) may be used in commercial, institutional, and residential applications for storing or displaying refrigerated or frozen objects. For example, refrigerated display cases can be used to display fresh food products (e.g., beef, pork, poultry, fish, etc.) in a supermarket or other commercial setting.

Refrigerated display cases typically include cooling elements (e.g. cooling coils, heat exchangers, evaporators, etc.) that receive a coolant (e.g. a liquid such as a glycol-water mixture, a refrigerant, etc.) from a cooling system (e.g., a refrigeration system) to provide cooling to the temperature-controlled space. Some refrigerated display cases include fans that can be used to move air over the cooling elements to facilitate heat transfer thereto. Fans may also be used to create an air barrier (e.g., an air curtain) to prevent outside air from entering the temperature-controlled space.

Some refrigerated display cases have doors that can be opened (e.g., by a customer) to access products within the temperature-controlled space. The position of the doors (i.e., open or closed) can be detected using a variety of well-known sensors. However, current refrigerated display cases are unable to anticipate when the doors are about to be opened and therefore are unable to preemptively implement different control strategies prior to the doors being physically opened.

Accordingly, it would be desirable to provide a refrigerated display device or case with the ability to detect when the doors are about to be opened that would overcome these and other disadvantages.

SUMMARY

One implementation of the present disclosure is a temperature-controlled display device. The temperature-controlled display device includes a temperature-controlled space and a refrigeration circuit configured to provide cooling for the temperature-controlled space. The refrigeration circuit is configured to operate in multiple cooling modes including a normal refrigeration mode and an anti-ingression mode. The temperature-controlled display device further includes a door having a handle configured to facilitate movement of the door between a closed position and an open position for accessing items within the temperature-controlled space and a proximity sensor configured to detect an object within a detection zone adjacent to the handle. In some embodiments, the proximity sensor is a projected capacitive sensor integrated with the handle. The temperature-controlled display device further includes a controller configured to estimate a distance between the handle and the object using an input from the proximity sensor. The controller is configured to cause the refrigeration circuit to transition between the multiple cooling modes based on the estimated distance. In some embodiments, the controller causes the refrigeration circuit to transition from the normal refrigeration mode into the anti-ingression mode in response to a determination that the estimated distance is less than a threshold value.

Another implementation of the present disclosure is a method for operating a temperature-controlled display device. The method includes detecting an object within a detection zone adjacent to a handle of the temperature-controlled display device. The handle is attached to a door of the temperature-controlled display device and configured to facilitate movement of the door between a closed position and an open position for accessing items within a temperature-controlled space. The method further includes estimating a distance between the handle and the object using an input from a proximity sensor and causing a refrigeration circuit of the temperature-controlled display device to transition between multiple cooling modes based on the estimated distance. The multiple cooling modes include a normal refrigeration mode and an anti-ingression mode.

Another implementation of the present disclosure is a temperature-controlled display device. The temperature-controlled display device includes a refrigeration circuit configured to provide cooling for a temperature-controlled space and to operate in multiple cooling modes. The temperature-controlled display device further includes a door having a handle configured to facilitate movement of the door between a closed position and an open position for accessing items within the temperature-controlled space and a projected capacitive sensor integrated with the handle. The projected capacitive sensor is configured to detect a hand or forearm of a user reaching for the handle. The temperature-controlled display device further includes a controller configured to cause the refrigeration circuit to transition between the multiple cooling modes in response to a detecting the hand or forearm of the user reaching for the handle.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, a refrigerated display case with a door handle proximity sensor is shown, according to an exemplary embodiment. The refrigerated display case includes a temperature-controlled space for storing and displaying objects such as refrigerated foods or other perishable objects. The refrigerated display case includes a door and a handle attached to the door for accessing objects stored within the temperature-controlled space.

The refrigerated display uses a proximity sensor to detect the presence of an object within a detection region near the door handle. The proximity sensor may use projected capacitance or any other type of proximity detection technology to anticipate when the display case door is about to be opened. For example, a capacitive sensor may be integrated with the door handle and may be used to detect the presence of a human hand reaching for the door handle.

In some embodiments, the sensor includes an electrode, a plate, or another electrically-conductive object defining one half of a capacitor. The sensor may project an electromagnetic field into a detection region near the door handle and may produce a signal indicating a capacitance relative to ground. An electromagnetic field absorbing object (e.g., a hand, forearm, or other body part of a user) within the detection region may effectively form the second half of the capacitor such that movement of the object toward or away from the capacitive sensor changes the measured capacitance.

A controller for the refrigerated display case uses a signal from the proximity sensor to estimate the distance between the door handle and the hand of a customer. The controller anticipates the display case door being opened (e.g., by comparing the estimated distance with a threshold value) and preemptively initiates a different mode of operation in response to a determination that the display case door is about to be opened. For example, the controller may cause one or more components of a refrigeration system for the refrigerated display case to shift into a more aggressive operating mode in anticipation of the display case door being opened. In some embodiments, shifting into the more aggressive operating mode includes increasing the speed of a display case fan to prevent the ingression of ambient air into the temperature-controlled space. Advantageously, the use of the proximity sensor allows the more aggressive operating more to be initiated at an optimal time prior to the display case door being opened.

Figure 1:
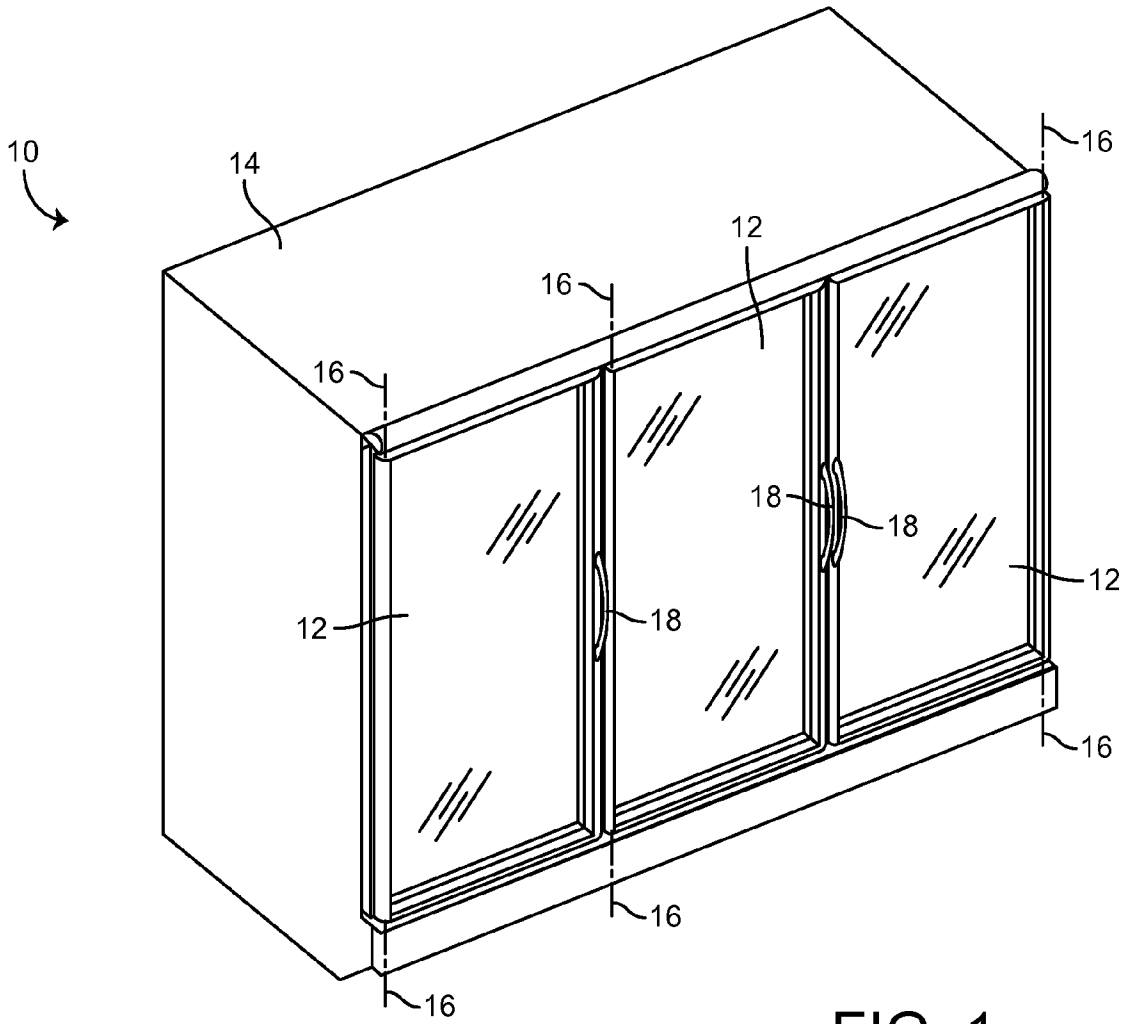
FIG. 1 is a perspective view of a temperature-controlled display device having a plurality of doors and handles, according to an exemplary embodiment.
Figure 2:
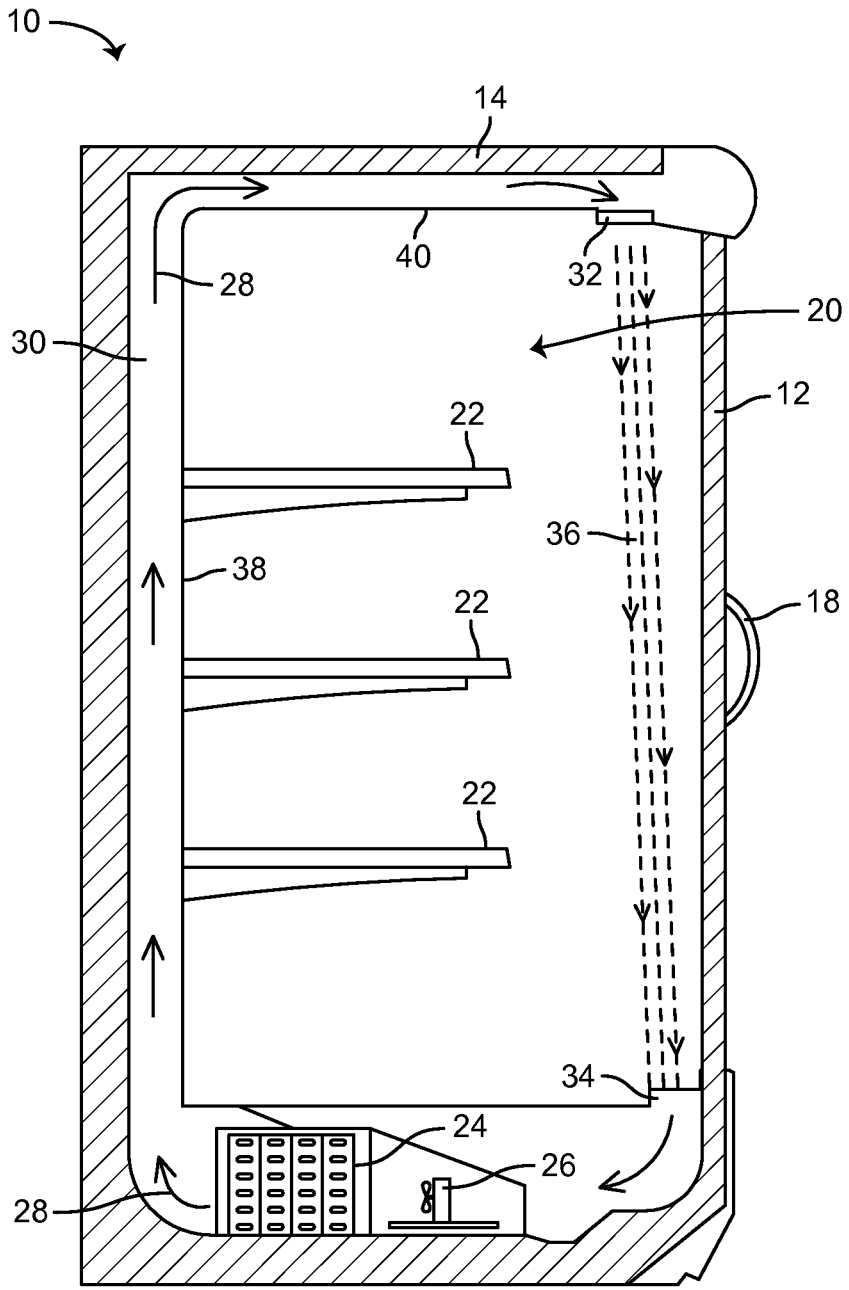
FIG. 2 is a cross-sectional elevation view of the temperature-controlled display device of FIG. 1 showing a temperature-controlled space and a fan configured to provide chilled air to the temperature-controlled space, according to an exemplary embodiment.

Referring now to FIGS. 1-2, a temperature-controlled display device 10 is shown, according to an exemplary embodiment. Temperature controlled-display device 10 may be a refrigerator, a freezer, a refrigerated merchandiser, a refrigerated display case, or other device capable of use in a commercial, institutional, or residential setting for storing and/or displaying refrigerated or frozen objects. For example, temperature-controlled display device 10 may be a service type refrigerated display case for displaying fresh food products (e.g., beef, pork, poultry, fish, etc.) in a supermarket or other commercial setting.

Temperature-controlled display device 10 is shown to include a plurality of doors 12 and a case 14. Doors 12 and case 14 at least partially define a temperature-controlled space 20 within which refrigerated or frozen objects can be stored. Temperature-controlled space 20 is shown to include a plurality of shelves 22 upon which refrigerated or frozen objects can be placed for storage and/or display. Doors 12 may define the front of temperature-controlled space 20 and case 14 may define the top, bottom, sides, and/or back of temperature-controlled space 20. In some embodiments, doors 12 are insulated glass doors including one or more transparent panels such that the objects within temperature-controlled space 20 can be viewed through doors 12 (i.e., from the exterior of display device 10) when doors 12 are closed.

Doors 12 may be configured to move between a closed position and an open position. In the closed position (shown in FIG. 1), doors 12 may prevent access to temperature-controlled space 20 and may contain chilled air within temperature-controlled space 20. In the open position, doors 12 may permit access to temperature-controlled space 20 to such that the refrigerated or frozen objects can be loaded into and/or removed from temperature-controlled space 20. As shown in FIG. 1, doors 12 may be rotatably connected to case 14 along axes 16 and may be configured to rotate about axes 16 between the closed position and the open position. In other embodiments, doors 12 may be sliding doors or panels configured to slide between the closed position and the open position.

Still referring to FIGS. 1-2, temperature-controlled display device 10 is shown to include handles 18. Handles 18 may be attached to doors 12 to facilitate moving doors 12 between the closed position and the open position. In some embodiments, handles 18 are attached to a front surface of doors 12.

Handles 18 may include proximity sensors integrated therewith. In various embodiments, the proximity sensors may be located inside handles 18, attached to handles 18, installed near handles 18, or otherwise positioned to monitor a detection zone near handles 18. The proximity sensors may be capacitive sensors (e.g., projected capacitive, mutual capacitive, self-capacitive, etc.) or other type of sensor (e.g., optical, microwave, ultrasound, magnetic, photoelectric, inductive, Doppler effect, sonar, radar, Eddy-current, etc.) configured to detect the presence of a customer's hand or forearm in a detection zone near handles 18 and/or touching handles 18. The proximity sensors and the operation thereof is described in greater detail with reference to FIGS. 4-8.

Referring specifically to FIG. 2, temperature-controlled display device 10 is shown to include a cooling element 24 and a fan 26. Cooling element 24 may include a cooling coil, a heat exchanger, an evaporator, or other component configured to provide cooling for temperature-controlled space 20. Cooling element 24 may be part of a refrigeration circuit (e.g., refrigeration circuit 50, shown in FIG. 3) and may be configured to absorb heat from an airflow 28 passing over or through cooling element 24.

Fan 26 may be configured to cause airflow 28 through cooling element 24. In some embodiments, fan 26 causes airflow 28 is from cooling element 24 through a channel 30 along a rear surface 38 and/or upper surface 40 of temperature-controlled space 20. Rear surface 38 and/or upper surface 40 may include a plurality of outlets distributed along channel 30 (e.g., holes in rear surface 38 and upper surface 40 into channel 30) through which airflow 28 can pass from channel 30 into temperature-controlled space 20.

Still referring to FIG. 2, channel 30 is shown to include an outlet 32 configured to direct airflow 28 downward from a front end of channel 30. The downward airflow from outlet 32 may form an air curtain 36 between outlet 32 and inlet 34. When door 12 is opened, air curtain 36 may help retain chilled air within temperature-controlled space 20 and may prevent the ingression of ambient air (e.g., warmer air from outside display device 10) into temperature-controlled space 20. When door 12 is closed, door 12 may seal temperature-controlled space 20 from the ambient environment outside display device 10 and may reduce or eliminate the utility of air curtain 36.

Air curtain 36 may be created by operating fan 26. The optimal time to create air curtain 36 may be before door 12 is opened so that air curtain 36 can be fully established by the time door 12 is opened. Advantageously, the proximity sensor integrated with handle 18 can detect when door 12 is about to be opened by detecting a user's hand or forearm in a detection zone near handle 18. Fan 26 may be activated or increased in speed (e.g., by a controller) in response to a determination that door 12 is about to be opened using input from the proximity sensor. Anticipating the opening of door 12 allows air curtain 36 to be fully established prior to opening door 12.

Temperature-controlled display device 10 may be operated in multiple different modes. When door 12 is closed, temperature-controlled display device 10 may be operated in a refrigeration mode to maintain conditions (e.g., temperature, humidity, air pressure, etc.) within temperature-controlled space 20 at a setpoint or within a setpoint range. When door 12 is opened or about to be opened, temperature-controlled display device 10 may be operated in a more aggressive mode to prevent the ingression of ambient air into temperature-controlled space 20 (e.g., increasing the speed of fan 26 to form air curtain 36, establishing a pressure gradient within temperature-controlled space 20, activating additional fans or cooling elements, etc.). Temperature-controlled display device 10 may determine when door 12 is about to be opened using input from the proximity sensor integrated with handle 18 and may transition from the refrigeration mode into the more aggressive mode in response to such a determination.

Figure 3:
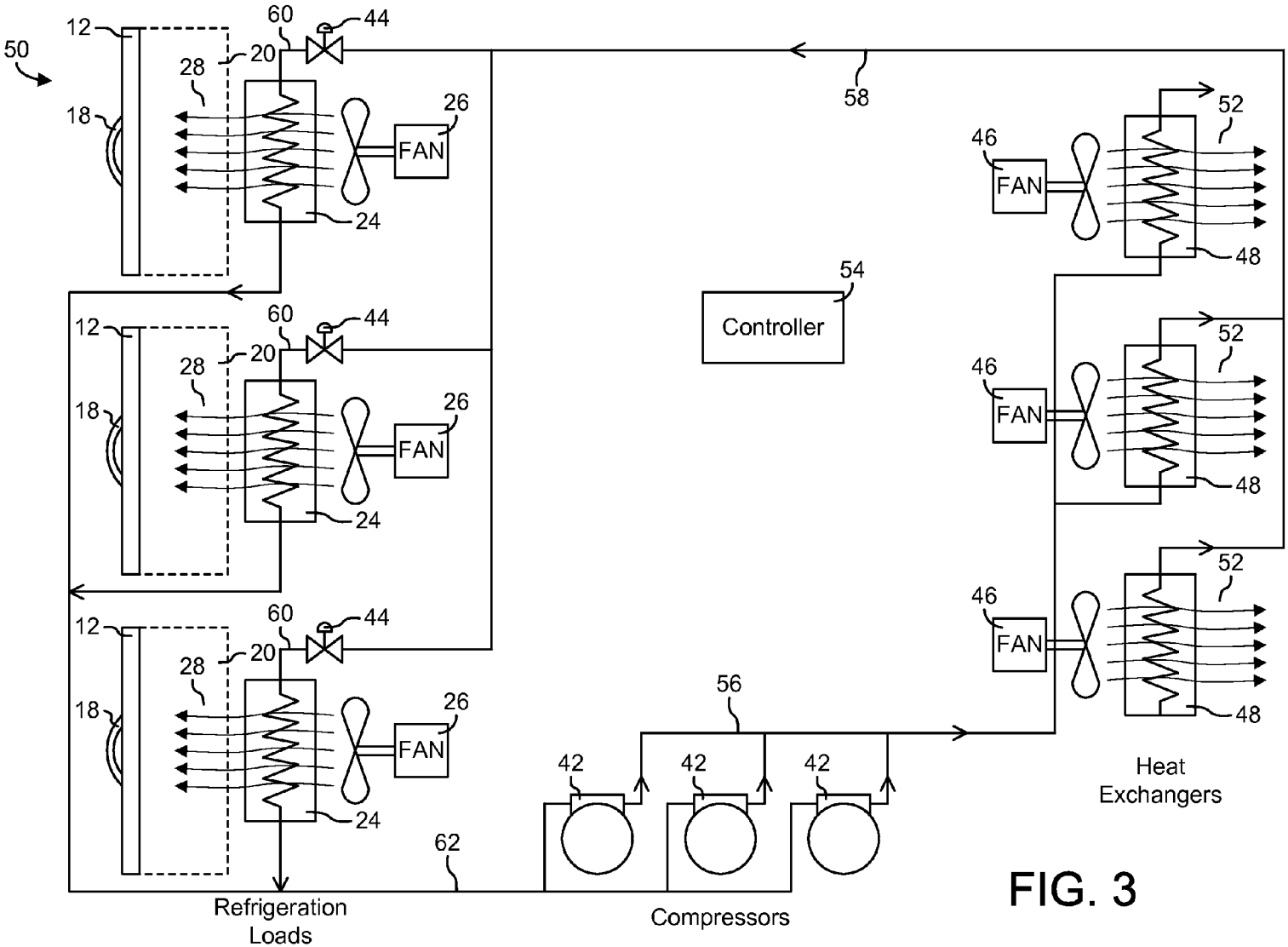
FIG. 3 is a block diagram of a refrigeration circuit that may be used by the temperature-controlled display device of FIG. 1 to provide cooling for the temperature-controlled space, according to an exemplary embodiment.

Referring now to FIG. 3, a refrigeration circuit 50 that may be used by temperature-controlled display device 10 is shown, according to an exemplary embodiment. Refrigeration circuit 50 is shown to include compressors 42, heat exchangers 48, expansion valves 44, and cooling elements 24. Compressors 42 may be configured to circulate a coolant (e.g. a liquid such as a glycol-water mixture, a refrigerant, etc.) through refrigeration circuit 50. In some embodiments, compressors 42 are operated by controller 54. For embodiments in which the coolant is a compressible refrigerant, compressors 42 may compress the refrigerant to a high pressure, high temperature state and discharge the compressed refrigerant into line 56. Line 56 is shown connecting the outlet of compressors 42 to the inlet of heat exchangers 48.

Heat exchangers 48 may be configured to cool the compressed refrigerant in line 56. In various embodiments, heat exchangers 48 may be gas coolers (i.e., heat exchangers configured to remove heat from gaseous refrigerant without causing condensation) or condensers (i.e., heat exchangers configured to condense a gaseous refrigerant to a liquid or mixed gas-liquid state). In some embodiments, heat exchangers 48 are heat-reclaim heat exchangers configured to use the heat absorbed from the compressed refrigerant for heating purposes (e.g., heating water, providing heat to a space, melting frost or ice, anti-condensate heating for display device 10, etc.). Heat exchangers 48 may be configured to transfer heat from the compressed refrigerant into another fluid circulating through heat exchangers 48 (e.g., another refrigerant, a separate refrigeration circuit, etc.) or into the ambient environment. In some embodiments, refrigeration circuit 50 includes fluid control valves immediately upstream or downstream of heat exchangers 48 to direct the refrigerant through a subset of heat exchangers 48.

In some embodiments, refrigeration circuit 50 includes fans 46 configured to cause an airflow 52 through or across heat exchangers 48. Fans 46 may be controlled by controller 54 to modulate the rate of heat transfer in heat exchangers 48. In some embodiments, fans 46 are variable speed fans capable of operating at multiple different speeds. Controller 54 may increase or decrease the speed of fans 46 in response to various inputs from refrigeration circuit 50 (e.g., temperature measurements, humidity measurements, enthalpy measurements, etc.).

Still referring to FIG. 3, line 58 is shown connecting an outlet of heat exchangers 48 to an inlet of expansion valves 44. Expansion valves 44 may be configured to expand the refrigerant in line 58 to a low temperature and low pressure state. Expansion valves 44 may be fixed position valves or variable position valves. Expansion valves 44 may be actuated manually or automatically (e.g., by controller 54 via a valve actuator) to adjust the expansion of the refrigerant passing therethrough. In some embodiments, expansion valves 44 may be operated as fluid control valves to direct the refrigerant through a subset of cooling elements 24. Expansion valves 44 may output the expanded refrigerant into line 60. Line 60 is shown extending from an outlet of expansion valves 44 to an inlet of cooling elements 24.

Cooling elements 24 may be the same as previously described with reference to FIG. 2. For example, cooling elements 24 may include cooling coils, heat exchangers, evaporators, or other components configured to provide cooling for temperature-controlled space 20. Cooling elements 24 may be configured to absorb heat from an airflow 28 passing over or through cooling elements 24. Cooling elements 24 may output the refrigerant into line 62, which connects to the suction side of compressors 42.

In some embodiments, refrigeration circuit 50 includes fans 26 configured to cause an airflow 28 through or across cooling elements 24. Fans 26 may be controlled by controller 54 to modulate the rate of heat transfer from temperature-controlled space 20 into cooling elements 24. In some embodiments, fans 26 are variable speed fans capable of operating at multiple different speeds. Controller 54 may increase or decrease the speed of fans 26 in response to various inputs from refrigeration circuit 50 (e.g., temperature measurements, humidity measurements, enthalpy measurements, etc.).

Fans 26 may be configured to generate an air curtain 36, to establish a pressure gradient, and/or generate a pressure differential within temperature-controlled space 20, as described with reference to FIG. 2. Fans 26 may be activated, deactivated, or speed modulated by controller 54 to transition between a normal refrigeration mode (e.g., a relatively lower fan speed) and a more aggressive air ingression prevention mode (e.g., a relatively higher fan speed).

Still referring to FIG. 3, refrigeration circuit 50 is shown to include a controller 54. Controller 54 may be configured to operate various components of refrigeration circuit 50 to provide refrigeration for temperature-controlled space 20. For example, controller 54 may operate compressors 42, fans 46, valves 44, fans 26, and/or other operable components of refrigeration circuit 50 (e.g., flow control valves, pressure regulation valves, etc.) to circulate a fluid refrigerant between heat exchangers 48 and cooling elements 24. Controller 54 may also control other components of display device 10 such as an anti-condensate heaters, a lighting element, a condensate dissipation system, and/or other auxiliary components of display device 10.

Controller 54 may receive input from various sensory devices of refrigeration circuit 50 (e.g., temperature sensors, humidity sensors, pressure sensors, enthalpy sensors, voltage sensors, proximity sensors, etc.) Sensors may be disposed at any location relative to temperature-controlled display device 10 and/or refrigeration circuit 50. For example, sensors may be positioned along any of lines 56-62, within temperature-controlled space 20, integrated with door handle 18, or otherwise positioned to measure any variable state or condition of temperature-controlled display device 10. Controller 54 may use the sensory inputs to determine appropriate control outputs for the operable components of refrigeration circuit 50.

Controller 54 may be configured to detect the presence of an object (e.g., a human hand or forearm) in a detection zone near handle 18. In some embodiments, handle 18 includes a projected capacitive sensor. Handle 18 may form one half of the capacitor and the detected object may form the other half of the capacitor. Controller 54 may calculate the capacitance of the capacitor by applying an alternating voltage to door handle 18 (e.g., to an internal conductor within handle 18, covered by an insulating shell) and measuring an alternating current between the voltage source and handle 18.

Controller 54 may use the calculated capacitance to estimate the distance between handle 18 and the detected object and to determine when door 12 is about to be opened. For example, controller 54 may determine that door 12 is about to be opened in response to a determination that the estimated distance between handle 18 and the detected object is less than a threshold value.

Controller 54 may operate refrigeration circuit 50 in multiple different modes including a normal refrigeration mode and a more aggressive anti-ingression mode. In the refrigeration mode, controller 54 may operate refrigeration circuit 50 to maintain conditions (e.g., temperature, humidity, air pressure, etc.) within temperature-controlled space 20 at a setpoint or within a setpoint range. Controller 54 may respond to a determination that door 12 is about to be opened by shifting into the anti-ingression mode. In the anti-ingression mode, controller 54 may operate refrigeration circuit 50 to prevent the ingression of ambient air into temperature-controlled space 20. For example, in the anti-ingression mode, controller 54 may increase the speed of fans 26 to form air curtain 36, establish a pressure gradient within temperature-controlled space 20, activate additional fans or cooling elements, and/or perform other control operations designed to maintain conditions within temperature-controlled space 20 when door 12 is opened. Controller 54 is described in greater detail with reference to FIG. 10.

Figure 4:
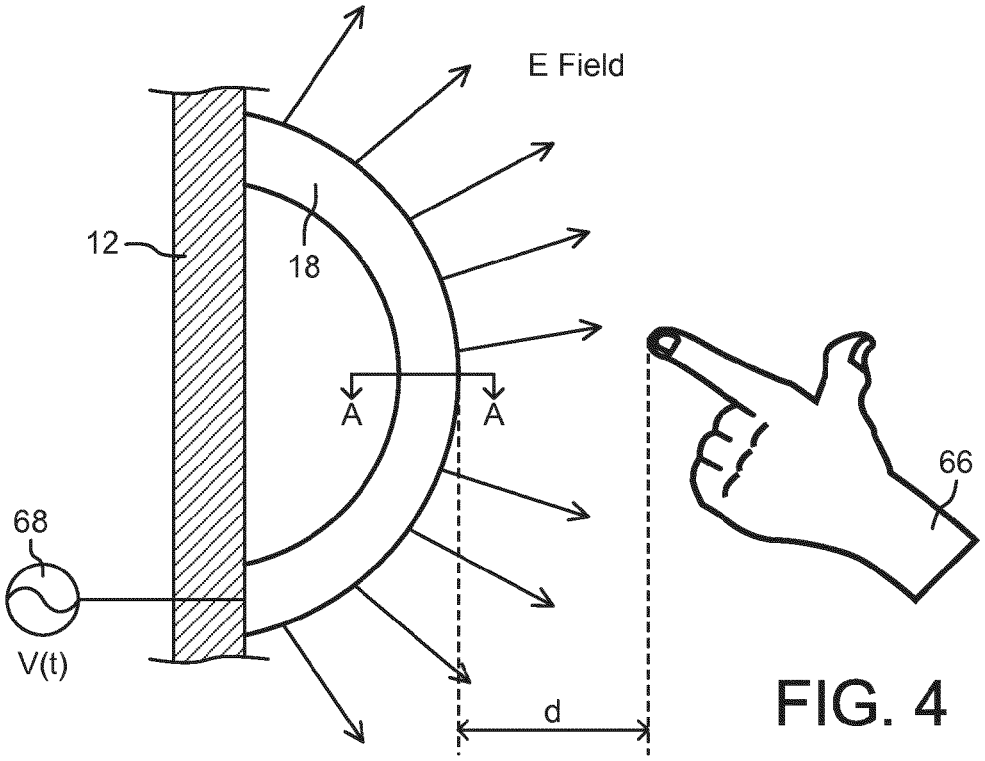
FIG. 4 is an elevation view of one of the handles of FIG. 1 showing an electrical connection between the handle and a voltage source and an electric field emanating in all directions from the handle, according to an exemplary embodiment.
Figure 5:
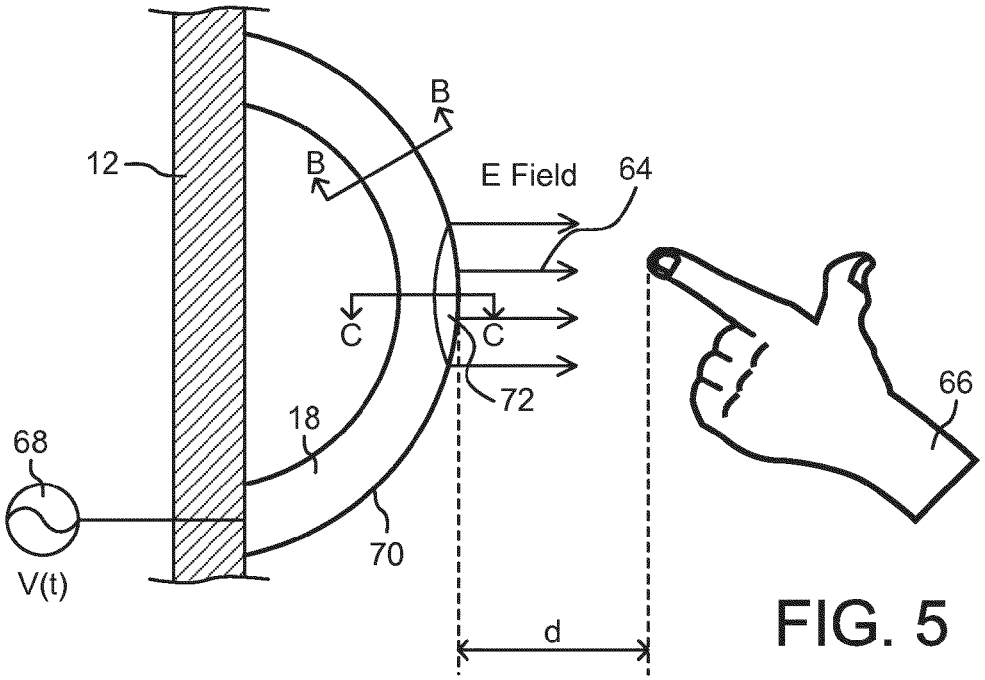
FIG. 5 is an elevation view of one of the handles of FIG. 1 showing an electromagnetic shield surrounding a shielded portion of the handle such that the electric field emanates only from an unshielded portion of the handle, according to an exemplary embodiment.

Referring now to FIGS. 4-8, handle 18 is shown in greater detail, according to various exemplary embodiments. Handle 18 may be attached to a front surface of door 12 such that handle 18 can be used to open and close door 12 from the exterior of temperature-controlled display device 10. In various embodiments, handle 18 may be a curved handle (as shown in FIGS. 4-5), a lever, a door knob, a hand grip, a flat panel (e.g., for push-to-open doors), a bar, or may have any other shape or configuration such that handle 18 can be touched or gripped to open door 12.

Referring specifically to FIGS. 4-5, handle 18 may be formed at least partially from an electrically-conductive material. Handle 18 may be electrically connected to a voltage source 68 configured to apply a voltage V(t) to handle 18. In some embodiments, voltage V(t) is an alternating voltage. Voltage source 68 may be operated by controller 54 and may be used to electrically charge handle 18 relative to an object 66 (e.g., a human hand or forearm) in the detection zone near handle 18 and/or relative to ground. The voltage V(t) of handle 18 may cause an electric field 64 to be generated outside handle 18.

Electric field 64 may emanate from the entire surface of handle 18 (as shown in FIG. 4) or from a particular portion of handle 18 (as shown in FIG. 5). In some embodiments, handle 18 includes a shield 70 configured to block electric field 64. For example, FIG. 5 illustrates an embodiment of handle 18 in which shield 70 covers most of handle 18 and electric field 64 emanates only from an unshielded portion 72 of handle 18. Shield 70 can be used to control the direction of electric field 64 such that electric field 64 is emanated only toward the detection zone.

Figure 6:
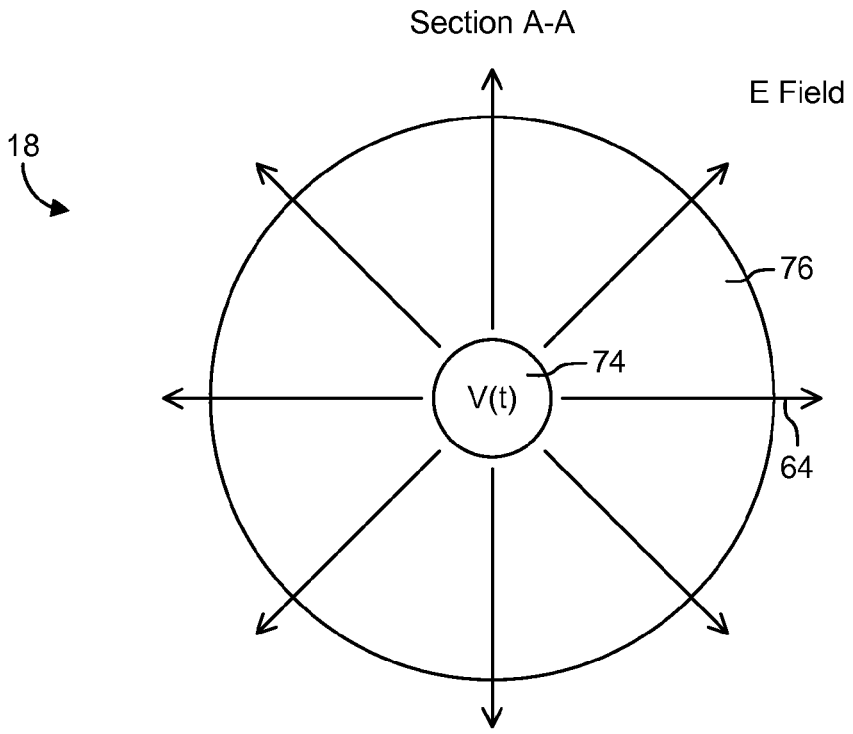
FIG. 6 is a cross-section of the handle shown in FIG. 4 taken at the line A-A, showing an electrically-conductive core within the handle and an electric field emanating in all directions from the handle, according to an exemplary embodiment.
Figure 7:
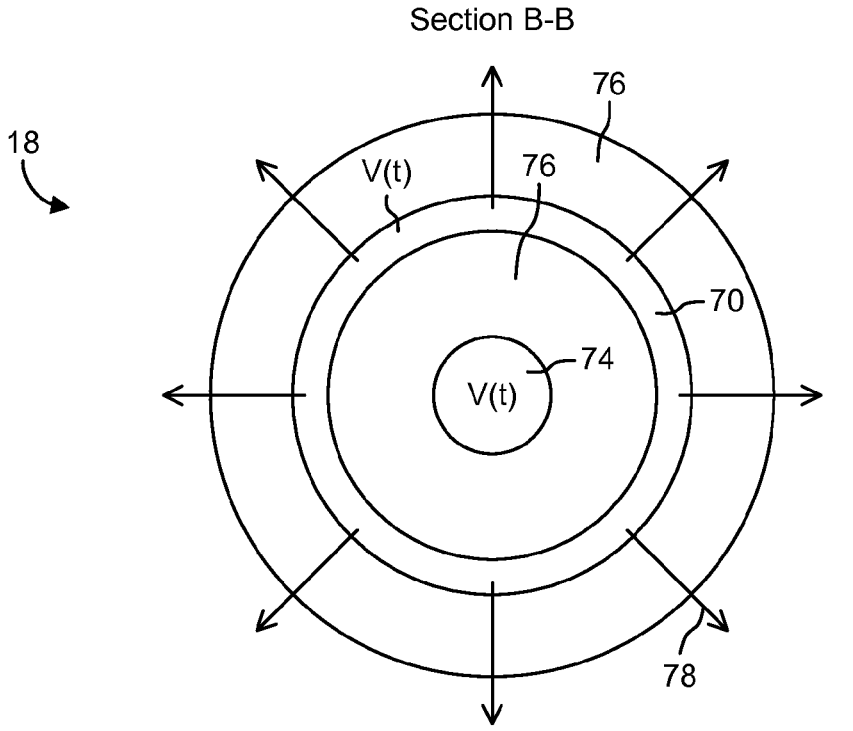
FIG. 7 is a cross-section of the handle shown in FIG. 5 taken at the line B-B, showing an electrically-conductive core and an electromagnetic shield maintained at the same voltage as the core surrounding the core on all sides such that any conductor external to the handle forms an electric field with the shield and not the core, according to an exemplary embodiment.
Figure 8:
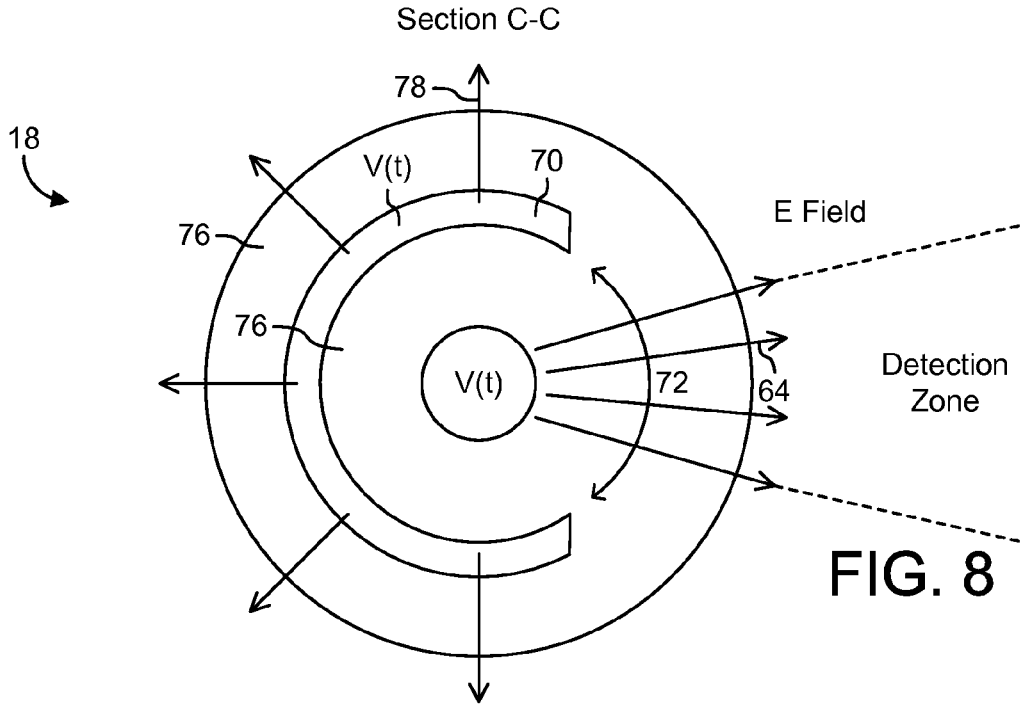
FIG. 8 is a cross-section of the handle shown in FIG. 5 taken at the line C-C, showing the electrically-conductive core and an electromagnetic shield maintained at the same voltage as the core surrounding some but not all of the core to direct the electric field emanating from the core only toward a detection zone in front of the handle, according to an exemplary embodiment.

Referring specifically to FIGS. 6-8, several cross sections of handle 18 are shown, according to an exemplary embodiment. In some embodiments, handle 18 has an electrically-conductive core 74 surrounded by an electrical insulator 76.

Voltage V(t) may be applied to core 74 by voltage source 68. Insulator 76 may form an outer shell around core 74 to protect core 74 from damage and/or to prevent charge from escaping from core 74. In other embodiments, handle 18 is a solid metal handle with no insulating shell.

In some embodiments, handle 18 does not include a shield 70. For example, FIG. 6 illustrates a cross-section A-A of the handle 18 shown in FIG. 4. In FIG. 6, handle 18 does not include a shield 70 and electric field 64 emanates from core 74 in all directions. Conductors on all sides of handle 18 may form an electric field 64 with core 74

In other embodiments, handle 18 includes a shield 70 surrounding some or all of core 74 at various locations along handle 18. For example, FIGS. 7-8 illustrate cross-sections B-B and C-C of the handle 18 shown in FIG. 5. FIG. 7 is a cross-section at a location B-B where shield 70 surrounds all of core 74. Shield 70 may be electrically connected to a separate conductor having the same value V(t) as voltage source 68 such that shield 70 and core 74 are electrically isolated but maintained at the same voltage V(t). By maintaining shield 70 and core 74 at voltage V(t), no electric field exists between shield 70 and core 74. As shown in FIG. 7, any conductor outside handle 18 will form a separate electric field 78 with shield 70 and not with core 74.

FIG. 8 is a cross-section at a location C-C where shield 70 surrounds some, but not all of core 74. Electric field 64 emanates from core 74 through unshielded portion 72. The rest of handle 18 is shielded by shield 70 and emanates a separate electric field 78 from shield 70. Advantageously, electric field 64 may be directed toward the detection zone to detect objects 66 only in the detection zone. Conductors in other locations will instead form an electric field 78 with shield 70 and will not affect the estimated capacitance between core 74 and the objects 66 in the detection zone.

Figure 9:
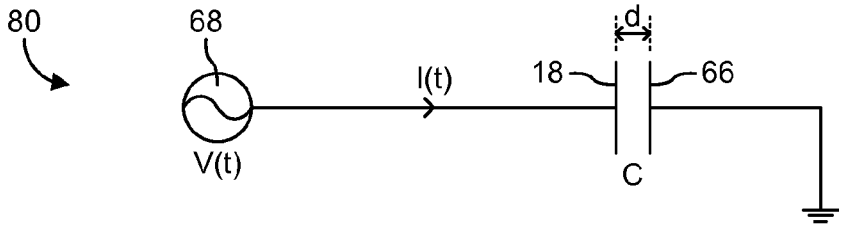
FIG. 9 is a circuit diagram illustrating a projected capacitive sensor that may be integrated with the handle of FIG. 1 for detecting an object such as a human hand or forearm in the detection zone in front of the handle, according to an exemplary embodiment.

Referring now to FIG. 9, a simplified circuit diagram 80 illustrating the capacitance sensing principle used by controller 54 to determine the distance d between handle 18 and an object 66 in the detection zone is shown, according to an exemplary embodiment. Object 66 may be, for example, a human hand or forearm reaching for handle 18. Controller 54 may use projected capacitance to determine the distance d between handle 18 and object 66. Handle 18 forms one half of a capacitor and object 66 forms the other half of the capacitor. The capacitance C of the capacitor is defined by equation $$82\left(\text{i.e., } I(t) = C\frac{dV(t)}{dt}\right), \text{ where } \frac{dV(t)}{dt}$$

is the derivative of the voltage V(t) applied by voltage source 68 and I(t) is the electric current between voltage source 68 and handle 18. Controller 54 may modulate voltage V(t) such that $$\frac{dV(t)}{dt}$$

is known. Controller 54 may measure electric current I(t) and calculate capacitance C using equation 82 and the known values of $$\frac{dV(t)}{dt}$$

and I(t).

Once the capacitance value C is known, controller 54 may use equation $$84\left(\text{i.e., } C = \frac{\varepsilon_0 KA}{d}\right)$$

to calculate the distance d between handle 18 and object 66, where $\in_0$ is the permittivity of free space, K is the dielectric constant of the material between handle 18 and object 66, and A is the area of handle 18 and object 66. It can be assumed that the sizes of handle 18 and object 66 are constant and therefore capacitance C is inversely proportional to distance $$d\left(\text{i.e., } C \propto \frac{1}{d}\right).$$

Controller 54 may interpret any change in capacitance C as a result of a change in the distance d between handle 18 and object 66.

Figure 10:
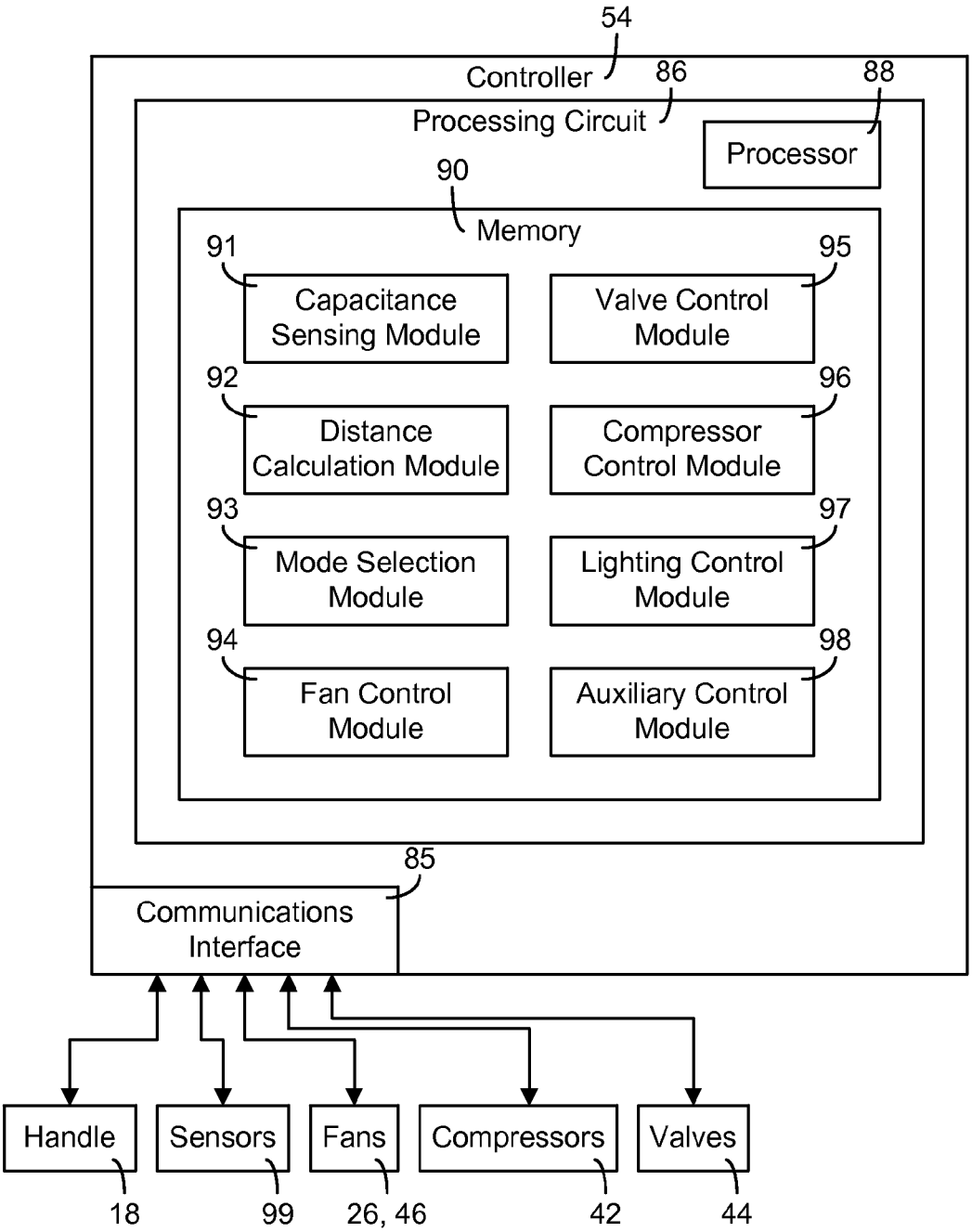
FIG. 10 is a block diagram of a controller that may be used to control the temperature-controlled display device of FIG. 1, according to an exemplary embodiment.

Referring now to FIG. 10, a block diagram of controller 54 is shown, according to an exemplary embodiment. Controller 54 is shown to include a communications interface 85 and a processing circuit 86. Communications interface 85 may include wired or wireless interfaces (e.g., jacks, antennas, transmitters, receivers, transceivers, wire terminals, etc.) for conducting data communications with various systems, devices, or networks. Communications interface 85 can include an Ethernet card and port for sending and receiving data via an Ethernet-based communications network. In another example, communications interface 85 includes a WiFi transceiver for communicating via a wireless communications network. Communications interface 85 may be configured to communicate via local area networks or wide area networks (e.g., the Internet, a building WAN, etc.) and may use a variety of communications protocols (e.g., BACnet, IP, point-to-point, etc.).

In some embodiments, controller 54 uses communications interface 85 to receive input from various sensors 99 of refrigeration circuit 50 (e.g., temperature sensors, humidity sensors, pressure sensors, enthalpy sensors, voltage sensors, proximity sensors, etc.). Sensors 99 may be disposed at any location relative to temperature-controlled display device 10 and/or refrigeration circuit 50. For example, sensors 99 may be positioned along any of lines 56-62, within temperature-controlled space 20, integrated with door handle 18, or otherwise positioned to measure any variable state or condition of temperature-controlled display device 10. Controller 54 may use inputs from sensors 99 to determine appropriate control outputs for the operable components of refrigeration circuit 50.

In some embodiments, controller 54 uses communications interface 85 to send control signals to various operable components of refrigeration circuit 50. For example, controller 54 may send control signals to compressors 42, fans 26, 46, valves 44, and/or other operable components of refrigeration circuit 50 (e.g., flow control valves, pressure regulation valves, etc.) to circulate a fluid refrigerant between heat exchangers 48 and cooling elements 24. In some embodiments, controller 54 uses communications interface 85 to communicate with other components of display device 10 such as an anti-condensate heaters, a lighting element, a condensate dissipation system, and/or other auxiliary components of display device 10.

Still referring to FIG. 10, processing circuit 86 is shown to include a processor 88 and memory 90. Processor 88 may be a general purpose or specific purpose processor, an application specific integrated circuit (ASIC), one or more field programmable gate arrays (FPGAs), a group of processing components, or other suitable processing components. Processor 88 is configured to execute computer code or instructions stored in memory 90 or received from other computer readable media (e.g., CDROM, network storage, a remote server, etc.).

Memory 90 may include one or more devices (e.g., memory units, memory devices, storage devices, etc.) for storing data and/or computer code for completing and/or facilitating the various processes described in the present disclosure. Memory 90 may include random access memory (RAM), read-only memory (ROM), hard drive storage, temporary storage, non-volatile memory, flash memory, optical memory, or any other suitable memory for storing software objects and/or computer instructions. Memory 90 may include database components, object code components, script components, or any other type of information structure for supporting the various activities and information structures described in the present disclosure. Memory 90 may be communicably connected to processor 88 via processing circuit 86 and may include computer code for executing (e.g., by processor 88) one or more processes described herein.

Still referring to FIG. 10, memory 90 is shown to include a capacitance sensing module 91. Capacitance sensing module 91 may be configured to estimate a capacitance C between handle 18 and an object 66 in a detection zone near handle 18. Object 66 may be, for example, a human hand or forearm reaching for handle 18.

Capacitance sensing module 91 may use projected capacitance to estimate the capacitance C between handle 18 and object 66. Using projected capacitance, handle 18 forms one half of a capacitor and object 66 forms the other half of the capacitor. The capacitance C of the capacitor is defined by the equation:

$$I(t) = C\frac{dV(t)}{dt}$$

(shown as equation 82 in FIG. 9), where $$\frac{dV(t)}{dt}$$

is the derivative of the voltage V(t) applied by voltage source 68 and I(t) is the electric current between voltage source 68 and handle 18.

Capacitance sensing module 91 may modulate voltage V(t) such that $$\frac{dV(t)}{dt}$$

is known. Capacitance sensing module 91 may measure electric current I(t) and calculate capacitance C using equation 82 and the known values of $$\frac{dV(t)}{dt}$$

and I(t). Capacitance sensing module 91 may estimate capacitance C using the equation:

$$C = \frac{I(t)}{\frac{dV(t)}{dt}}$$

Still referring to FIG. 10, memory 90 is shown to include a distance calculation module 92. Distance calculation module 92 may be configured to calculate the distance d between handle 18 and object 66. Distance calculation module 92 may use the capacitance value C estimated by capacitance sensing module 91 to calculate distance d. For example, distance calculation module 92 may use the equation:

$$C = \frac{\varepsilon_0 KA}{d}$$

(shown as equation 84 in FIG. 9), where $\in_0$ is the permittivity of free space, K is the dielectric constant of the material between handle 18 and object 66, and A is the area of handle 18 and object 66.

In some embodiments, distance calculation module 92 simplifies equation 84 by assuming that the sizes of handle 18 and object 66 are constant. With this assumption, equation 84 reduces to the simplified equation:

$$C \propto \frac{1}{d}$$

which expresses the inverse relationship between capacitance C and distance d (i.e., capacitance C is inversely proportional to distance d). Distance calculation module 92 may interpret any change in capacitance C as a result of a change in the distance d between handle 18 and object 66.

Still referring to FIG. 10, memory 90 is shown to include a mode selection module 93. Mode selection module 93 may be configured to select an operating mode for temperature-controlled display device 10 and/or refrigeration circuit 50 based on the distance d calculated by distance calculation module 92. In some embodiments, mode selection module 93 compares the calculated distance d with a threshold value.

If the calculated distance d is not less than the threshold value (i.e., d≥threshold), mode selection module 93 may select a normal refrigeration mode. In the normal refrigeration mode, controller 54 may operate temperature-controlled display device 10 to maintain conditions (e.g., temperature, humidity, air pressure, etc.) within temperature-controlled space 20 at a setpoint or within a setpoint range. Mode selection module 93 may select the normal refrigeration mode in response to a determination that a user is not within a threshold distance of handle 18 (i.e., d≥threshold) and therefore door 12 is not about to be opened.

If the calculated distance d is less than the threshold value (i.e., d<threshold), mode selection module 93 may select a more aggressive anti-ingression mode. In the anti-ingression mode, controller 54 may operate temperature-controlled display device 10 may to prevent the ingression of ambient air into temperature-controlled space 20. For example, controller 54 may increase the speed of fan 26 to form air curtain 36, establish a pressure gradient within temperature-controlled space 20, activate additional fans or cooling elements, and/or perform other control operations designed to maintain conditions within temperature-controlled space 20 when door 12 is opened. Mode selection module 93 may select the ant-ingression mode in response to a determination that a user is within a threshold distance of handle 18 (e.g., a user is reaching for handle 18, d<threshold) and therefore door 12 is about to be opened.

Mode selection module 93 is configured to transition from the normal refrigeration mode into the more aggressive anti-ingression mode using input from the proximity sensor integrated with handle 18. Advantageously, using proximity-based input for mode selection allows mode selection module 93 to transition into the anti-ingression mode before door 12 is opened and before any physical contact is made with handle 18. Mode selection module 93 can initiate the anti-ingression mode preemptively in anticipation of door 12 being opened such that air curtain 36 and/or other anti-ingression measures are fully implemented by the time door 12 is opened. This allows for the anti-ingression measures to be more effective and enhances the energy efficiency of temperature-controlled display device 10.

Still referring to FIG. 10, memory 90 is shown to include a fan control module 94, a valve control module 95, a compressor control module 96, a lighting control module 97, and an auxiliary control module 98. Control modules 94-98 may be configured to control various components of temperature-controlled display device 10. Fan control module 94 may be configured to control fans 26 and 46. Valve control module 95 may be configured to control expansion valves 44 and/or other valves (e.g., fluid control valves) of refrigeration circuit 50. Compressor control module 96 may be configured to control compressors 42. Lighting control module 97 may be configured to control interior or exterior lighting elements of display device 10. Auxiliary control module 98 may be configured to control auxiliary components of display device 10 such as an anti-condensate heating element, a condensate dissipation system, a user interface, and/or other auxiliary components that may be present in various implementations.

Control modules 94-98 may communicate with operable components of temperature-controlled display device 10 via communications interface 85. In some embodiments, control modules 94-98 are configured to identify the current operating mode of display device 10 determined by mode selection module 93. Control modules 94-98 may adjust the control signals sent via communication interface 85 based on the current operating mode. For example, fan control module 94 may increase the speed of fans 26 and/or 46 in response to a determination that the current operating mode has changed from the normal refrigeration mode to the more aggressive anti-ingression mode. In some embodiments, lighting control module 97 turns on/off or adjusts a brightness of a controlled lighting element upon a transition between operating modes.

Advantageously, control modules 94-98 may send control signals instructing various operable components of temperature-controlled display device 10 to change operating modes before door 12 is physically opened or touched. For example, control modules 94-98 may implement anti-ingression measures preemptively in anticipation of door 12 being opened. Such a preemptive implementation allows air curtain 36 and/or other anti-ingression measures to be fully implemented by the time door 12 is opened, thereby increasing the effectiveness of the anti-ingression measures and enhancing the energy efficiency of temperature-controlled display device 10.

Figure 11:
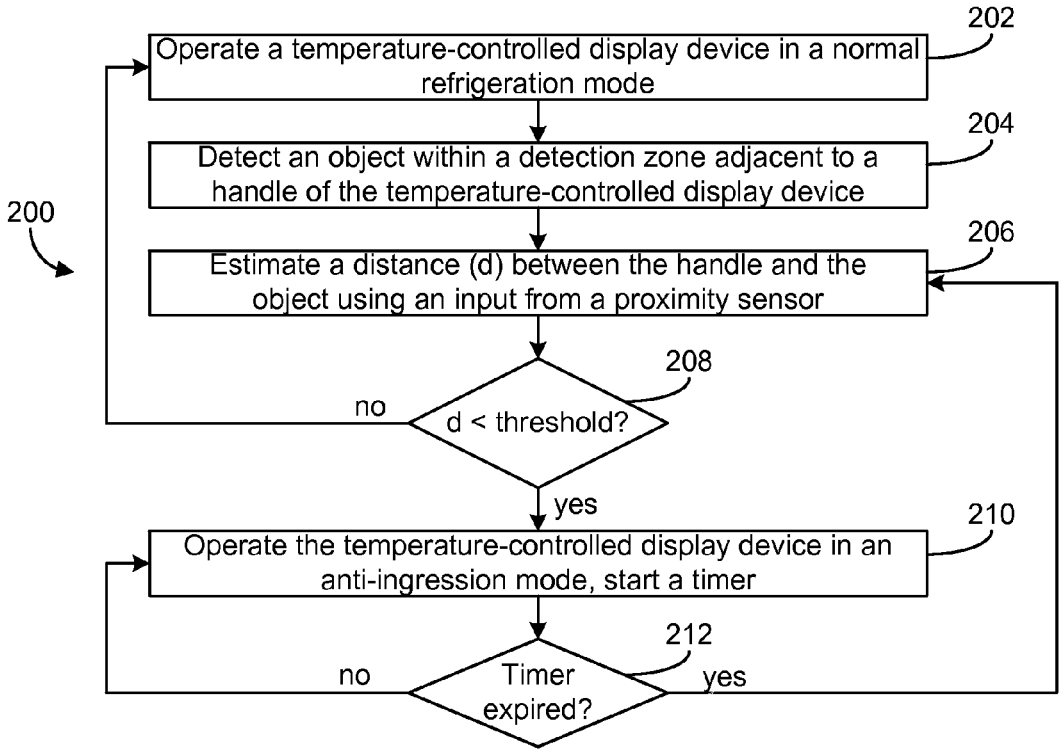
FIG. 11 is a flowchart of a process for operating the temperature-controlled display device of FIG. 1, according to an exemplary embodiment.

Referring now to FIG. 11, a flowchart of a process 200 for operating a temperature-controlled display device is shown, according to an exemplary embodiment. Process 200 may be performed by controller 54 as described with reference to FIGS. 1-10. Using process 200, controller 54 may transition between multiple operating modes (e.g., a normal refrigeration mode, an anti-ingression mode, etc.) based on an estimated distance d between a handle of the temperature-controlled display device and an object (e.g., a human hand or forearm) in a detection zone adjacent to the handle. Process 200 allows controller 54 to anticipate when a door of the temperature-controlled display device is about to be opened and to transition into a more aggressive anti-ingression mode before the door is opened.

Process 200 is shown to include operating a temperature-controlled display device in a normal refrigeration mode (step 202). In the normal refrigeration mode, the temperature-controlled display device may be operated to maintain conditions (e.g., temperature, humidity, air pressure, etc.) within a temperature-controlled space at a setpoint or within a setpoint range. Step 202 may include receiving signals from various sensors of the temperature-controlled display device (e.g., temperature sensors, humidity sensors, enthalpy sensors, valve position sensors, proximity sensors, etc.) to determine an appropriate control signal for operable components of the temperature-controlled display device (e.g., compressors, valves, fans, etc.).

In some embodiments, step 202 includes operating a fan of the temperature-controlled display device at a first speed. The first speed may be a relatively lower speed and may be sufficient to maintain conditions within the temperature-controlled space when a door of the temperature-controlled display device is closed.

Still referring to FIG. 11, process 200 is shown to include detecting an object within a detection zone adjacent to a handle of the temperature-controlled display device (step 204). Step 204 may include using a proximity sensor integrated with the handle to detect the presence of a user's hand or forearm in the detection zone. In various embodiments, the proximity sensor may be located inside the handle, attached to the handle, installed near the handle, or otherwise positioned to monitor the detection zone adjacent to the handle. The proximity sensor may be a capacitive sensor (e.g., projected capacitive, mutual capacitive, self-capacitive, etc.) or other type of sensor (e.g., optical, microwave, ultrasound, magnetic, photoelectric, inductive, Doppler effect, sonar, radar, Eddy-current, etc.) configured to detect the presence of an object in the detection zone.

Process 200 is shown to include estimating a distance d between the handle and the object using an input from the proximity sensor (step 206). In some embodiments, step 206 includes estimating a capacitance C between the handle and the object using projected capacitance principles. Using projected capacitance, the handle forms one half of a capacitor and the object forms the other half of the capacitor. The capacitance C of the capacitor is defined by the equation:

$$I(t) = C\frac{dV(t)}{dt}$$

where $$\frac{dV(t)}{dt}$$

is the derivative of the voltage V(t) applied to the handle and I(t) is the electric current between the voltage source and the handle.

Step 206 may include modulating modulate voltage V(t) such that $$\frac{dV(t)}{dt}$$

is known and measuring the electric current I(t) between the voltage source and the handle. Step 206 may include calculating capacitance C using the known values of $$\frac{dV(t)}{dt}$$

and I(t) and the following equation:

$$C = \frac{I(t)}{\frac{dV(t)}{dt}}$$

In some embodiments, step 206 includes using the estimated capacitance value C to calculate distance d. For example, step 206 may include using the following equation to calculate distance d:

$$d = \frac{\varepsilon_0 KA}{C}$$

where $\in_0$ is the permittivity of free space, K is the dielectric constant of the material between the handle and the detected object, and A is the area of the handle and the detected object.

Since the sizes of the handle and the detected object can be assumed to be constant, the preceding equation can be simplified to:

$$d \propto \frac{1}{C}$$

which expresses the inverse relationship between capacitance C and distance d (i.e., distance d is inversely proportional to capacitance C). Step 206 may include interpreting any change in capacitance C as a result of a change in the distance d between the handle and the detected object.

Still referring to FIG. 11, process 200 is shown to include comparing the distance d estimated in step 206 with a threshold value (step 208). The threshold value may be a threshold distance within which it can be assumed that the a user is reaching for the handle and therefore the door of the temperature-controlled display device is about to be opened.

If the estimated distance is not less than the threshold value (i.e., the result of step 208 is "no"), process 200 may return to step 202 during which the temperature-controlled display device is operated in the normal refrigeration mode. If the estimated distance is less than the threshold value (i.e., the result of step 208 is "yes"), process 200 may proceed to step 210.

Still referring to FIG. 11, process 200 is shown to include operating the temperature-controlled display device in an anti-ingression mode (step 210). In the anti-ingression mode, the temperature-controlled display device may be operated to prevent the ingression of ambient air into the temperature-controlled space. For example, step 210 may include increasing the speed of one or more fans to form an air barrier (e.g., an air curtain) over an opening into the temperature-controlled space that will be uncovered when the door is moved into the open position. Step 210 may include establishing a pressure gradient within the temperature-controlled space, activating additional fans or cooling elements, and/or performing other control operations designed to maintain conditions within the temperature-controlled space when the door is opened.

In some embodiments, step 210 includes starting a timer. The timer defines a minimum duration for which the temperature-controlled display device will be operated in the anti-ingression mode. Process 200 is shown to include determining whether the timer is expired (step 212). If the timer has not yet expired (i.e., the result of step 212 is "no"), process 200 may return to step 210 and continue to operate in the anti-ingression mode. Returning to step 210 directly from step 212 may not reset the timer. Process 200 may remain in the anti-ingression mode until the timer has expired.

Once the timer has expired (i.e., the result of step 212 is "yes"), process 200 may return to step 206. The distance d between the handle and the proximity sensor may be re-estimated in step 206 and compared with the threshold distance value in step 208. If the re-estimated distance is still less than the threshold value (i.e., the result of step 208 is "yes"), process 200 may proceed to step 210 and may remain in the anti-ingression mode. Proceeding to step 210 from step 208 may restart the timer. If the re-estimated distance is not less than the threshold value (i.e., the result of step 208 is "no"), process 200 may return to step 202 during which the temperature-controlled display device is operated in the normal refrigeration mode.

In some embodiments, the temperature-controlled display device includes multiple doors (as shown in FIG. 1). Each door may have its own corresponding handle and corresponding proximity sensor configured to detect an object in a detection region adjacent to the corresponding handle. A separate instance of process 200 may be performed for each door of the temperature-controlled display device. Multiple instances of process 200 may be performed concurrently and may share the same timer. If any of the instances of process 200 proceed to step 210 from step 208, the timer may be reset and the temperature-controlled display device may remain in the anti-ingression mode until all instances of process 200 return to step 202. In other words, detecting an object within the threshold distance of any of the proximity sensors may trigger a transition into the anti-ingression mode for the entire refrigeration circuit.

In other embodiments, each instance of process 200 is independent (e.g., no shared timers or mode transitions) and affects a separate portion of the temperature-controlled display device. For example, the temperature-controlled display device may include multiple fans, each fan configured to generate an air curtain over a different door opening. Each fan may be individually controlled (i.e., increased in speed) in response to a determination that the door corresponding to the fan is about to be opened. In this way, the fans can be controlled so that only the fans that are necessary to provide an air curtain over an open door (or a door that is about to be opened) are operated at the higher speed. The remaining fans can be maintained at a relatively lower speed to conserve energy.

Figure 12:
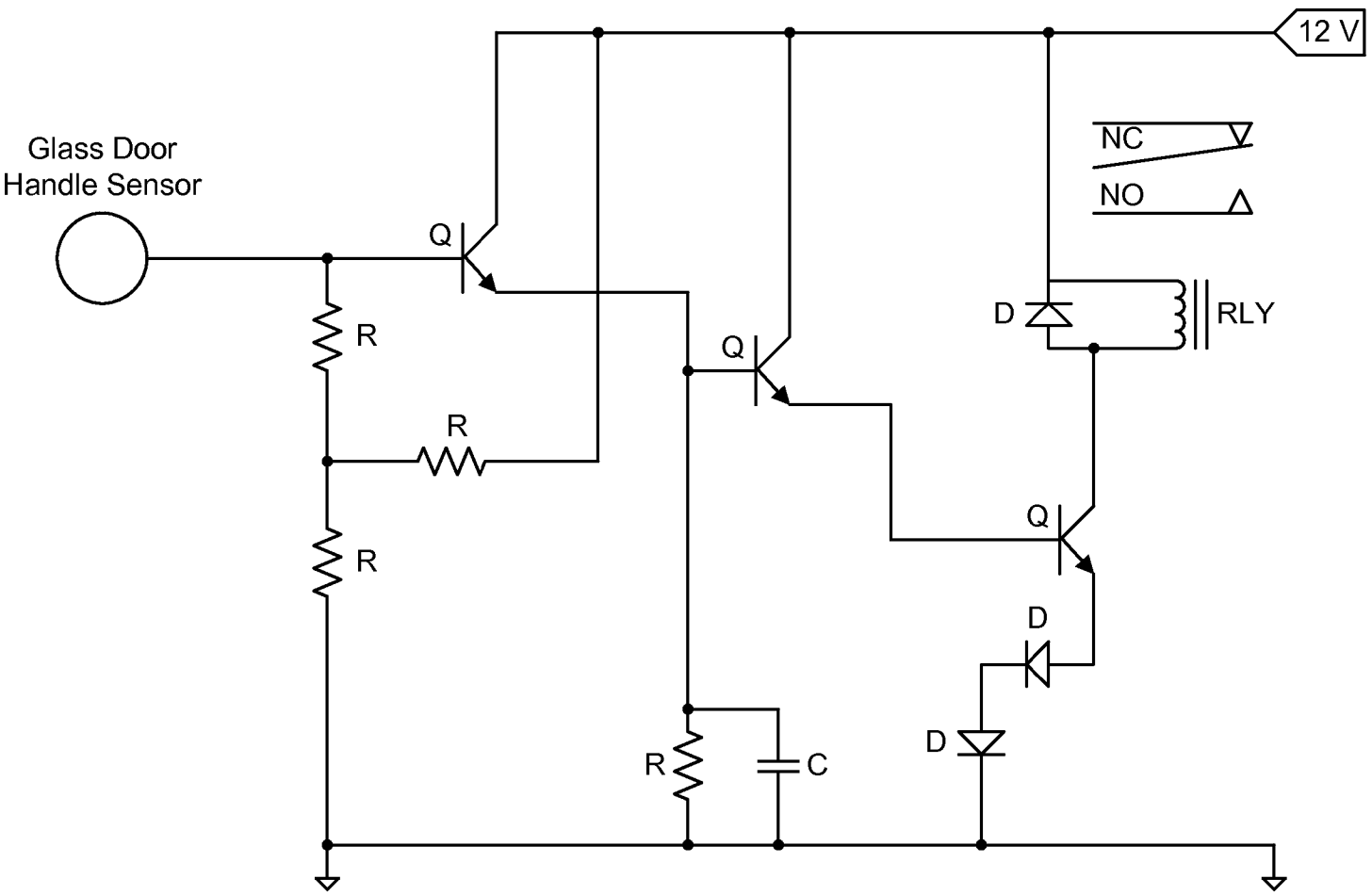
FIGS. 12-14 are circuit diagrams illustrating circuit elements that may be used to apply a voltage to the handle of FIG. 1 and to measure a capacitance associated with the handle, according to an exemplary embodiment.
Figure 13:
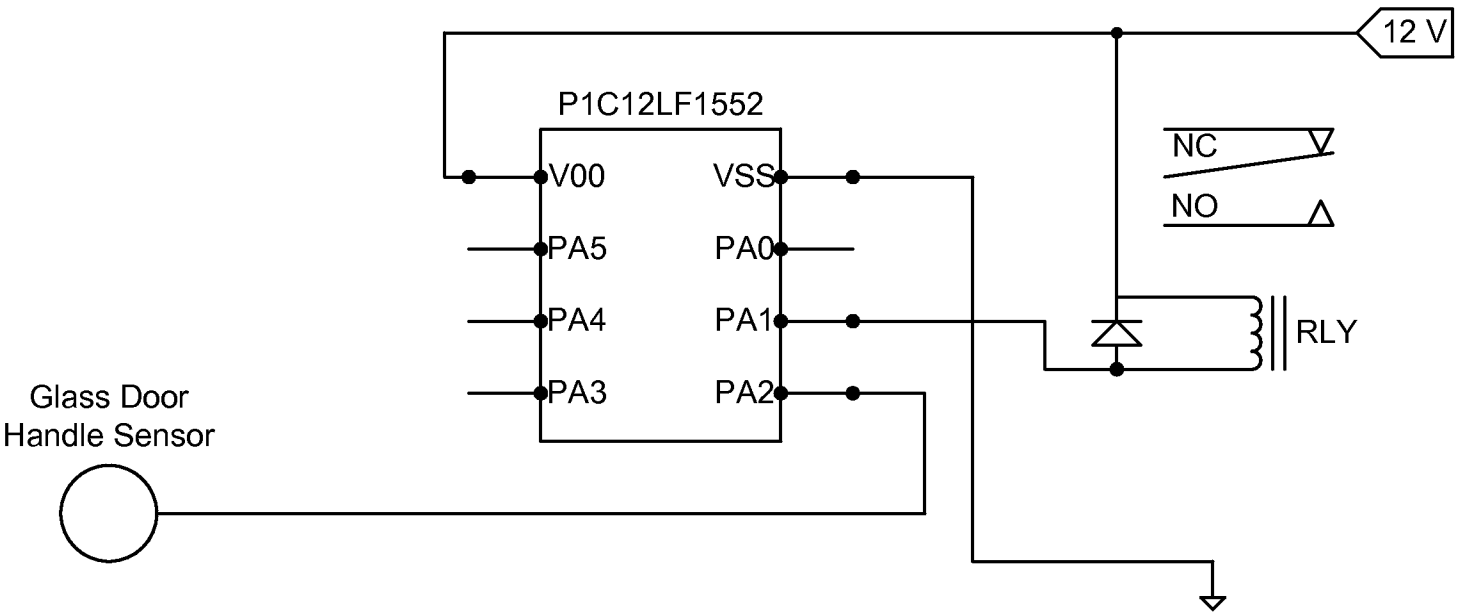
Figure 14:
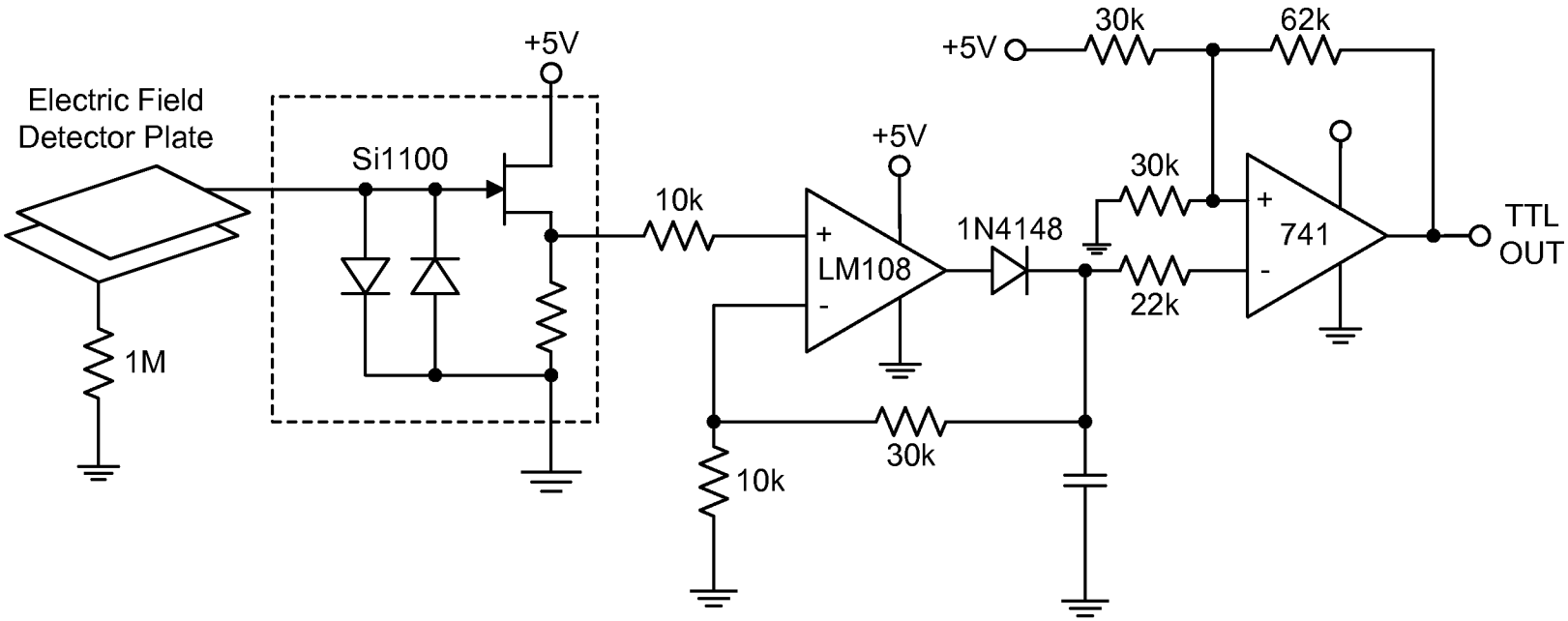

Referring now to FIGS. 12-14, several circuit diagrams that may be used to implement the door handle proximity sensor of the present disclosure are shown, according to an exemplary embodiment. As shown in FIG. 12, a voltage (e.g., 12 V) may be applied to the door handle sensor. In some embodiments, the voltage is an alternating voltage. The capacitance of a capacitor formed by the door handle sensor can be determined by measuring the electric current between the voltage source and the door handle sensor. Other branches of the circuit facilitate this measurement or allow the current to be measured in terms of a voltage between other nodes of the circuit. FIG. 13 illustrates an embodiment in which a micro circuit or microprocessor is used in place of the circuit elements shown in FIG. 12. FIG. 14 illustrates another embodiment of a circuit that may be used to apply a voltage to the door handle sensor and to measure the capacitance of a capacitor formed by the door handle sensor. In each of FIGS. 12-14, capacitance may be measured using equation 82, as described with reference to FIG. 9.

The construction and arrangement of the systems and methods as shown in the various exemplary embodiments are illustrative only. Although only a few implementations of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for anyone or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean serving as an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A temperature-controlled display device comprising:

a temperature-controlled space;

a refrigeration circuit configured to provide cooling for the temperature-controlled space and to operate in multiple cooling modes comprising a normal refrigeration mode and an anti-ingression mode;

a door having a handle configured to facilitate movement of the door between a closed position and an open position for accessing items within the temperature-controlled space;

a proximity sensor configured to detect an object within a detection zone adjacent to the handle; and a controller configured to estimate a distance between the handle and the object using an input from the proximity sensor and to cause the refrigeration circuit to transition between the multiple cooling modes based on the estimated distance.

2. The temperature-controlled display device of claim 1, wherein the object is a human hand or forearm reaching for the handle.

3. The temperature-controlled display device of claim 1, wherein the controller is configured to cause the refrigeration circuit to transition from the normal refrigeration mode to the anti-ingression mode in response to a determination that the distance between the handle and the object is less than a threshold value.

4. The temperature-controlled display device of claim 1, wherein the controller is configured to:

determine whether the door is about to be opened using the estimated distance; and cause the refrigeration circuit to transition into the anti-ingression mode in response to a determination that the door is about to be opened.

5. The temperature-controlled display device of claim 4, wherein the controller is configured to cause the refrigeration circuit to transition into the anti-ingression mode before the door is opened and before physical contact is made with the door or the handle.

6. The temperature-controlled display device of claim 1, further comprising a variable speed fan;

wherein the controller is configured to increase a speed of the fan upon transitioning into the anti-ingression mode.

7. The temperature-controlled display device of claim 1, wherein the controller is configured to implement an anti-ingression measure upon transitioning into the anti-ingression mode, wherein the anti-ingression measure inhibits an ingression of ambient air into the temperature-controlled space.

8. The temperature-controlled display device of claim 7, wherein implementing the anti-ingression measure comprises establishing an air barrier covering an opening into the temperature-controlled space, wherein the opening is covered by the door when the door is in the closed position.

9. The temperature-controlled display device of claim 1, wherein the proximity sensor is a projected capacitive sensor, the handle forming a first half of a capacitor and the object forming a second half of the capacitor;

wherein the controller is configured to estimate a capacitance between the handle and the object using the input from the proximity sensor.

10. The temperature-controlled display device of claim 9, wherein the controller is configured to estimate the distance between the handle and the object using the estimated capacitance therebetween.

11. The temperature-controlled display device of claim 1, wherein the controller is configured to start a timer upon transitioning into the anti-ingression mode and to automatically transition from the anti-ingression mode into the normal refrigeration mode upon expiration of the timer.

12. The temperature-controlled display device of claim 11, further comprising a second door for accessing items within the temperature-controlled space, the second door having a second handle and a second proximity sensor configured to detect a second object within a second detection zone adjacent to the second handle;

wherein the controller is configured to reset the timer in response to a determination that the second object is detected within the second detection zone.

13. A method for operating a temperature-controlled display device, the method comprising:

detecting an object within a detection zone adjacent to a handle of the temperature-controlled display device, wherein the handle is attached to a door of the temperature-controlled display device and configured to facilitate movement of the door between a closed position and an open position for accessing items within a temperature-controlled space;

estimating a distance between the handle and the object using an input from a proximity sensor; and causing a refrigeration circuit of the temperature-controlled display device to transition between multiple cooling modes based on the estimated distance, the multiple cooling modes comprising a normal refrigeration mode and an anti-ingression mode.

14. The method of claim 13, wherein the object is a human hand or forearm reaching for the handle.

15. The method of claim 13, wherein causing the refrigeration circuit to transition between multiple cooling modes based on the estimated distance comprises:

causing the refrigeration circuit to transition from the normal refrigeration mode to the anti-ingression mode in response to a determination that the distance between the handle and the object is less than a threshold value.

16. The method of claim 13, further comprising:

determining whether the door is about to be opened using the estimated distance; and causing the refrigeration circuit to transition into the anti-ingression mode in response to a determination that the door is about to be opened.

17. The method of claim 16, wherein the transition into the anti-ingression mode occurs before the door is opened and before physical contact is made with the door or the handle.

18. The method of claim 13, further comprising:

increasing a speed of a variable speed fan of the temperature-controlled display device upon transitioning into the anti-ingression mode.

19. The method of claim 13, further comprising:

implementing an anti-ingression measure upon transitioning into the anti-ingression mode, wherein the anti-ingression measure inhibits an ingression of ambient air into the temperature-controlled space.

20. The method of claim 19, wherein implementing the anti-ingression measure comprises establishing an air barrier covering an opening into the temperature-controlled space, wherein the opening is covered by the door when the door is in the closed position.

21. The method of claim 13, wherein the proximity sensor is a projected capacitive sensor, the handle forming a first half of a capacitor and the object forming a second half of the capacitor;

the method further comprising estimating a capacitance between the handle and the object using the input from the proximity sensor.

22. The method of claim 21, further comprising:

estimating the distance between the handle and the object using the estimated capacitance therebetween.

23. The method of claim 13, further comprising:

starting a timer upon transitioning into the anti-ingression mode; and automatically transitioning from the anti-ingression mode into the normal refrigeration mode upon expiration of the timer.

24. The method of claim 23, wherein the temperature-controlled display device comprises a second door for accessing items within the temperature-controlled space, the second door having a second handle and a second proximity sensor configured to detect a second object within a second detection zone adjacent to the second handle;

the method further comprising resetting the timer in response to a determination that the second object is detected within the second detection zone.

25. A temperature-controlled display device comprising:

a refrigeration circuit configured to provide cooling for a temperature-controlled space and to operate in multiple cooling modes;

a door having a handle configured to facilitate movement of the door between a closed position and an open position for accessing items within the temperature-controlled space;

a projected capacitive sensor integrated with the handle and configured to detect a hand or forearm of a user reaching for the handle; and a controller configured to cause the refrigeration circuit to transition between the multiple cooling modes in response to a detecting the hand or forearm of the user reaching for the handle.

26. The temperature-controlled display device of claim 25, wherein the handle forms a first half of a capacitor and the hand or forearm of the user forms a second half of the capacitor;

wherein the controller is configured to estimate a capacitance between the handle and the hand or forearm of the user.

27. The temperature-controlled display device of claim 26, further comprising a voltage source configured to apply a voltage to the handle.

28. The temperature-controlled display device of claim 27, wherein estimating the capacitance between the handle and the hand or forearm of the user comprises:

measuring an electric current between the voltage source and the handle; and using the measured electric current and the voltage applied to the handle to calculate the capacitance.

29. The temperature-controlled display device of claim 26, wherein the controller is configured to estimate the distance between the handle and the hand or forearm of the user using the estimated capacitance therebetween.

30. The temperature-controlled display device of claim 25, wherein the controller is configured to:

determine whether the door is about to be opened using an input from the projected capacitive sensor; and cause the refrigeration circuit to transition between the multiple cooling modes in response to a determination that the door is about to be opened.

31. The temperature-controlled display device of claim 30, wherein the controller is configured to cause the refrigeration circuit to transition between the multiple cooling modes before the door is opened and before physical contact is made with the door or the handle.

32. The temperature-controlled display device of claim 25, wherein the multiple cooling modes comprise a normal refrigeration mode and an anti-ingression mode, the anti-ingression mode configured to inhibit an ingression of ambient air into the temperature-controlled space.

33. The temperature-controlled display device of claim 25, wherein the projected capacitive sensor comprises an electrically-conductive core and an electromagnetic shield at least partially surrounding the electrically-conductive core.

34. The temperature-controlled display device of claim 33, wherein the electrically-conductive core and the electromagnetic shield are maintained at equal voltages to eliminate any electric field between the electrically-conductive core and the electromagnetic shield.

* * * * *